US011462871B2

(12) United States Patent
Kovach et al.

(10) Patent No.: US 11,462,871 B2
(45) Date of Patent: Oct. 4, 2022

(54) POWER SUPPLY BOX FOR USE WITH AN ARCHITECTURAL-STRUCTURE COVERING

(71) Applicant: Hunter Douglas Inc., Pearl River, NY (US)

(72) Inventors: Joseph E. Kovach, Broomfield, CO (US); Kevin M. Dann, Englewood, CO (US); Jesse Perreault, Denver, CO (US); Brian Hodd, Westminster, CO (US)

(73) Assignee: Hunter Douglas Inc., Pearl River, NY (US)

( * ) Notice: Subject to any disclaimer, the term of this patent is extended or adjusted under 35 U.S.C. 154(b) by 532 days.

(21) Appl. No.: 16/659,652

(22) Filed: Oct. 22, 2019

(65) Prior Publication Data

US 2021/0119473 A1 Apr. 22, 2021

(51) Int. Cl.
*H01R 25/00* (2006.01)

(52) U.S. Cl.
CPC ..... *H01R 25/006* (2013.01)

(58) Field of Classification Search
CPC ..... H01R 25/006; H01R 25/003
See application file for complete search history.

(56) References Cited

U.S. PATENT DOCUMENTS

| | | | |
|---|---|---|---|
| 3,269,454 A | 8/1966 | Gill | |
| 3,310,099 A | 3/1967 | Hunter | |
| 4,913,214 A | 4/1990 | Ming | |
| 4,951,730 A | 8/1990 | Hsu | |
| 4,979,550 A | 12/1990 | Long | |
| 5,540,269 A | 7/1996 | Plumer | |
| 5,547,008 A | 8/1996 | Sullivan | |
| 5,883,480 A | 3/1999 | Domel et al. | |
| 6,060,852 A | 5/2000 | Domel et al. | |
| 6,441,575 B1 | 8/2002 | Peterson | |
| 6,598,652 B1 | 7/2003 | Montesinos Alonso | |
| 6,755,230 B2 * | 6/2004 | Ulatowski | E06B 9/361 160/168.1 V |

(Continued)

FOREIGN PATENT DOCUMENTS

| | | |
|---|---|---|
| CN | 204764900 U | 11/2015 |
| DE | 19627988 C1 | 11/1997 |

(Continued)

*Primary Examiner* — Tho D Ta
(74) *Attorney, Agent, or Firm* — KDB Firm PLLC

(57) ABSTRACT

A power supply unit for use with one or more motorized architectural-structure coverings is disclosed. In one example of an embodiment, the power supply unit includes one or more features to simplify installation. For example, in one embodiment, the power supply unit does not require an installer to access an internal compartment of the power supply unit. In addition, and/or alternatively, in one embodiment, a cable extending between the power supply unit and the motorized architectural-structure covering include same gender connectors for facilitating easier installation and reducing installation errors. In one embodiment, the power supply unit includes a power connector accessible through an outer surface thereof for receiving line-voltage and a plurality of low-voltage connectors accessible through the outer surface for supplying low-voltage to a plurality of motorized architectural-structure coverings.

14 Claims, 5 Drawing Sheets

(56) References Cited

U.S. PATENT DOCUMENTS

| | | | | |
|---|---|---|---|---|
| 6,850,017 | B1 | 2/2005 | Domel et al. | |
| 7,723,939 | B2 | 5/2010 | Carmen, Jr. | |
| 7,931,068 | B2 | 4/2011 | Carmen, Jr. et al. | |
| 9,371,687 | B2 | 6/2016 | Yu et al. | |
| 9,371,691 | B2 | 6/2016 | Yu et al. | |
| 9,702,189 | B2 | 7/2017 | Chen | |
| 10,044,157 | B2 * | 8/2018 | Suri | H01R 25/006 |
| 10,263,373 | B2 * | 4/2019 | Byrne | H02J 7/0013 |
| 2004/0035535 | A1 | 2/2004 | Petrongolo | |
| 2004/0169490 | A1 | 9/2004 | Heurtault | |
| 2006/0086874 | A1 | 4/2006 | Habel et al. | |
| 2009/0278703 | A1 | 11/2009 | Iglesias Ballester | |
| 2015/0079838 | A1 * | 3/2015 | Hung | H01R 25/003 439/502 |
| 2015/0108841 | A1 * | 4/2015 | Weber | H02J 4/00 307/31 |
| 2017/0081916 | A1 | 3/2017 | Greening | |
| 2017/0362888 | A1 | 12/2017 | Vinogradova et al. | |
| 2018/0287315 | A1 * | 10/2018 | Izaki | H01R 31/06 |
| 2018/0298682 | A1 | 10/2018 | Huang et al. | |
| 2018/0301916 | A1 | 10/2018 | Nien et al. | |
| 2018/0355666 | A1 | 12/2018 | Lin | |

FOREIGN PATENT DOCUMENTS

| | | | |
|---|---|---|---|
| DE | 19635163 | A1 | 3/1998 |
| DE | 29900625 | U1 | 4/1999 |
| DE | 202006004002 | U1 | 6/2006 |
| DE | 102009034146 | B3 | 2/2011 |
| DE | 202009018179 | U1 | 4/2011 |
| DE | 102014108546 | A1 | 12/2014 |
| DE | 202015008064 | U1 | 12/2015 |
| EP | 1500776 | A2 | 1/2005 |
| EP | 1936103 | B1 | 7/2010 |
| EP | 3091169 | B1 | 9/2019 |
| FR | 2731743 | A1 | 9/1996 |
| FR | 2743390 | A1 | 7/1997 |
| FR | 2906065 | A1 | 3/2008 |
| FR | 2912564 | A1 | 8/2008 |
| KR | 101811684 | B1 | 12/2017 |
| WO | WO-2018000040 | A1 * | 1/2018 |

* cited by examiner

POWER SUPPLY BOX FOR USE WITH AN ARCHITECTURAL-STRUCTURE COVERING

FIELD OF THE DISCLOSURE

The present disclosure relates generally to architectural-structure coverings, and more particularly to a power supply unit for use with motorized architectural-structure coverings.

BACKGROUND OF THE DISCLOSURE

Architectural-structure coverings for architectural openings and/or structures, such as windows, doors, archways, portions of a wall, and the like (collectively an architectural structure without the intent to limit), have taken numerous forms for many years. One known architectural-structure covering includes a covering or covering portion (used interchangeably herein without the intent to limit) such as a fabric that is movable between an extended position and a retracted position. For example, the covering can be moved between an extended position and a retracted position for obscuring and exposing the underlying architectural structure.

The architectural-structure covering may include a motorized controller to move the covering between the extended and retracted positions (e.g., raise and lower the covering). For example, a motorized drive motor (e.g., an electric motor) can be provided to move the covering between the extended position and the retracted position. In one embodiment, the operating system may include an operating element such as, for example, a hand-held remote, an APP running on a smartphone or tablet, etc.

Use of motorized controllers to move the covering of an architectural-structure covering between the extended and retracted positions requires the architectural-structure covering to be connected to a source of electrical power. In homes, restaurants, businesses, and other buildings having multiple architectural-structural coverings, a power supply unit may be utilized to supply power to each of the motorized architectural-structure coverings.

Generally speaking, it would be beneficial to provide a power supply unit that is installer friendly. For example, it would be beneficial to provide a power supply unit that does not require the installer to access the internal compartment of the power supply unit, thus preventing, or at least reducing the likelihood that the installer needs to manage line-voltage connections. In addition, it would be beneficial to provide a power supply unit that provides increased plug and play capabilities to facilitate easier installation, thus reducing the likelihood of installation errors.

It is with respect to these and other considerations that the features and/or aspects of the present disclosure may be useful.

SUMMARY

This Summary is provided to introduce in a simplified form, a selection of concepts that are further described below in the Detailed Description. This Summary is not intended to identify key features or essential features of the claimed subject matter, nor is it intended as an aid in determining the scope of the claimed subject matter.

Disclosed herein is a power supply unit, housing, etc. (used interchangeably herein without the intent to limit) for providing power to one or more motorized architectural-structure coverings. The architectural-structure coverings include a covering movable between an extended position and a retracted position and a motor (e.g., an electrical motor) for moving the covering between the extended and retracted positions.

The power supply unit may be arranged and configured to receive mains or line-voltage power, to convert the line-voltage power to low-voltage power, and to supply the low-voltage power to, for example, the motorized architectural-structure coverings. In use, the low-voltage power can be provided to the motorized architectural-structure coverings to power the electrical motor used to move the covering between the extended and retracted positions.

In one example of an embodiment, the power supply unit includes one or more features to simplify installation. For example, in one embodiment, the power supply unit is arranged and configured so that an installer is not required to access an internal compartment of the power supply unit (e.g., installer does not need to remove a cover to access the internal circuity in order to make the required line-voltage and low-voltage connections, e.g., to connect to the motor and/or electrical outlet). In addition, and/or alternatively, in one embodiment, a cable extending between the power supply unit and the motorized architectural-structure coverings include same gender connectors on each end thereof for facilitating easier installation and reducing installation errors.

In one example of an embodiment, the power supply unit includes a power connector accessible through an outer surface of the power supply unit for receiving line-voltage and a plurality of low-voltage connectors accessible through the outer surface of the power supply unit for supplying low-voltage to the motorized architectural-structure coverings.

Additionally, and/or alternatively, in one example of an embodiment, the power supply unit includes a power connector, inlet, or plug accessible through an outer surface of the power supply unit for receiving a power cord, which is arranged and configured to be coupled to an electrical outlet.

Additionally, and/or alternatively, in one example of an embodiment, the power supply unit includes a plurality of low-voltage connectors extending through an outer surface of the power supply unit for receiving a cable, which is arranged and configured to be coupled to one of the motorized architectural-structure coverings.

Additionally, and/or alternatively, in one example of an embodiment, the low-voltage connectors of the power supply unit have the same gender connector as the connector associated with the motorized architectural-structure coverings so that the cables extending between the power supply unit and the motorized architectural-structure covering are arranged and configured to utilize the same gender connectors on both the first and second ends thereof so that the cable is not specific as to which end is placed adjacent to the motorized architectural-structure covering and which end is placed adjacent to the power supply unit. Thus, easier installation is facilitated.

Figure 1:
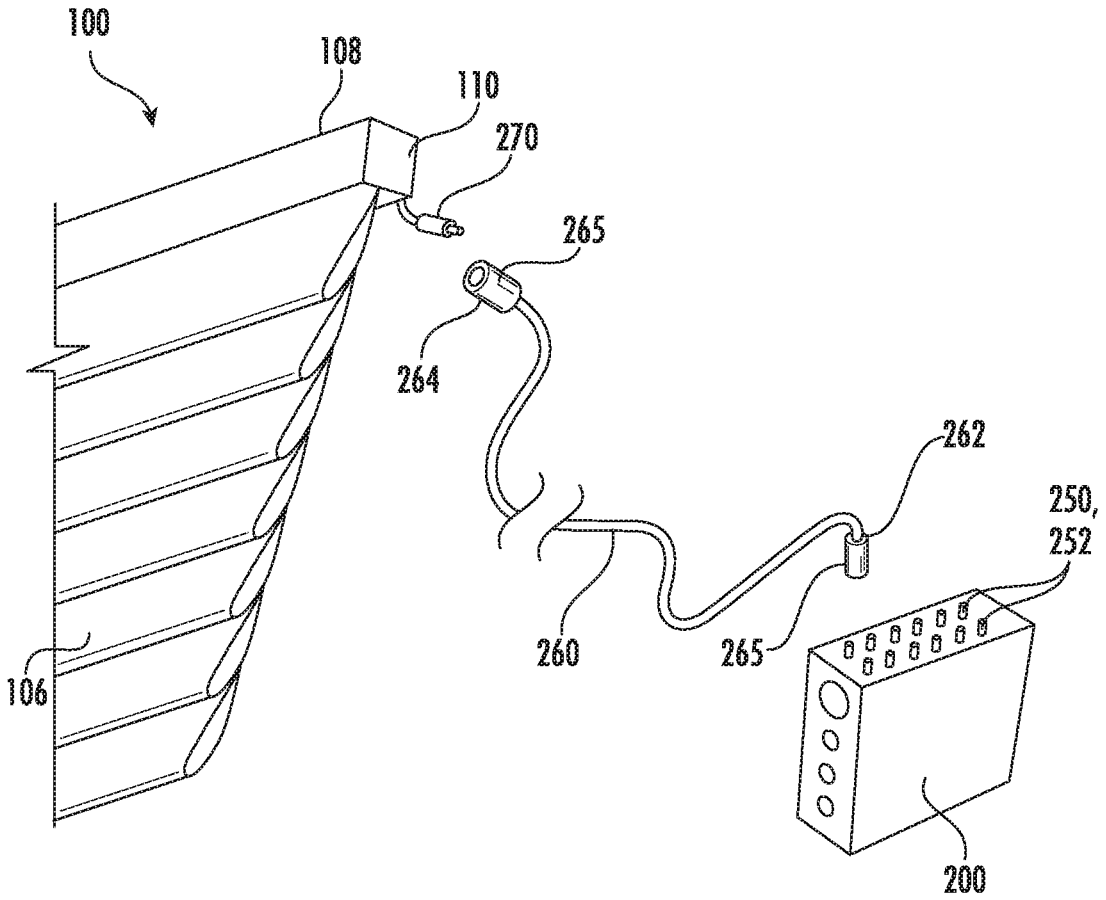
FIG. 1 is a perspective, exploded view illustrating an example of a power supply unit in connection with one or more aspects of the present disclosure, the power supply unit being coupled to an example of an embodiment of a motorized architectural-structure covering.
Figure 2:
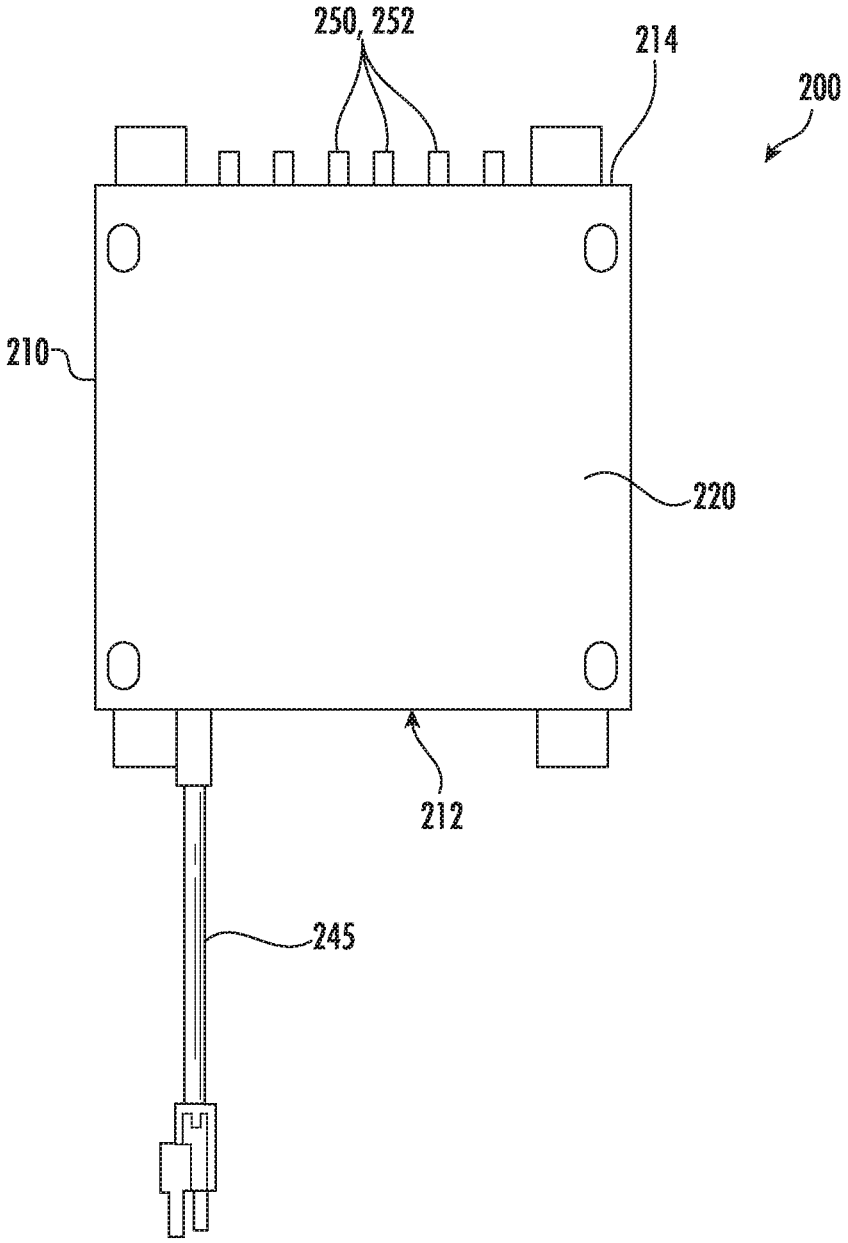
FIG. 2 is a front view illustrating an example of an embodiment of a power supply unit in connection with one or more aspects of the present disclosure, the power supply unit being arranged and configured to couple to, for example, the architectural-structure covering of FIG. 1 to supply power to the architectural-structure covering.
Figure 3:
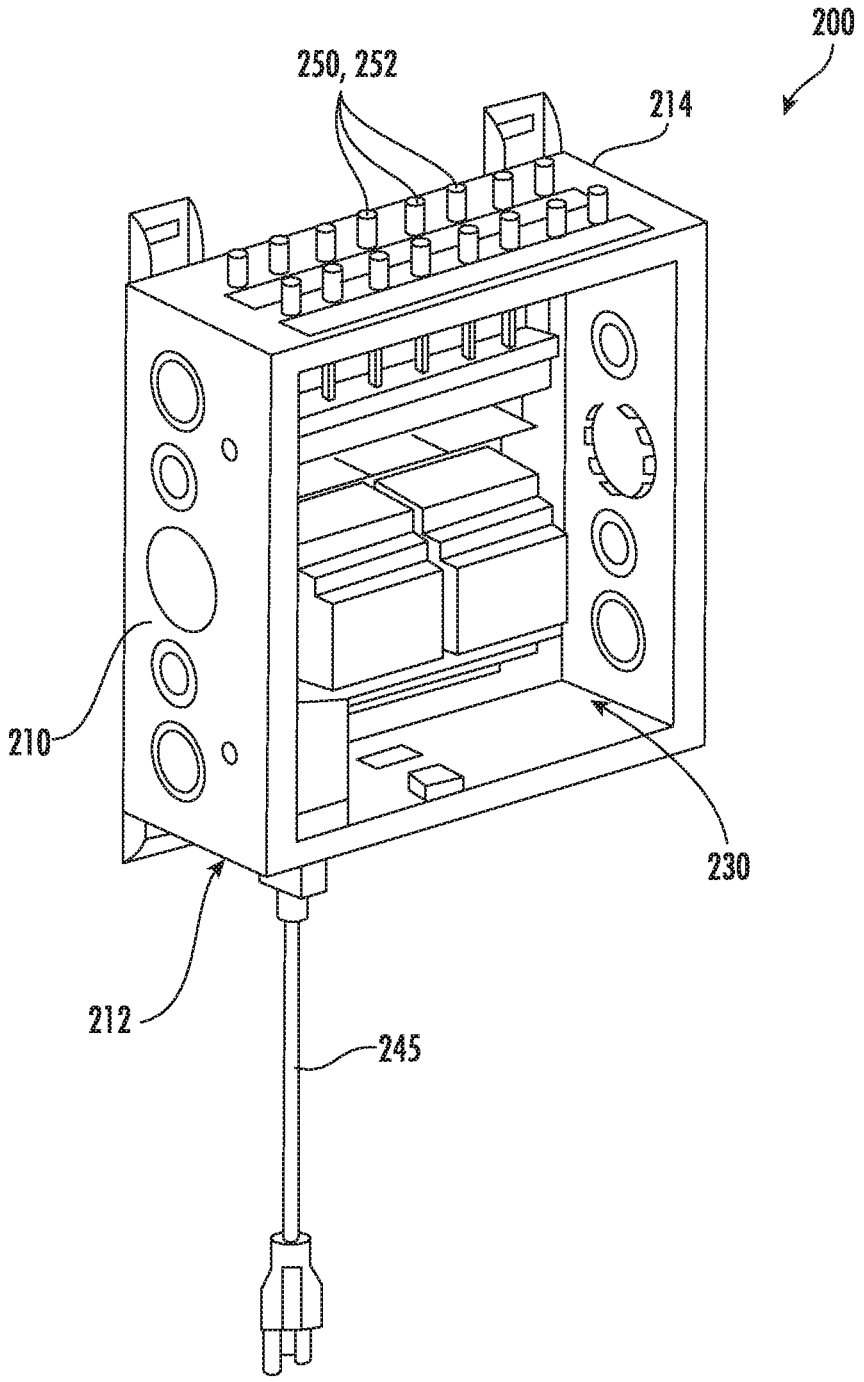
FIG. 3 is a front, perspective view of the power supply unit shown in FIG. 2, the power supply unit shown with a front cover removed.
Figure 4:
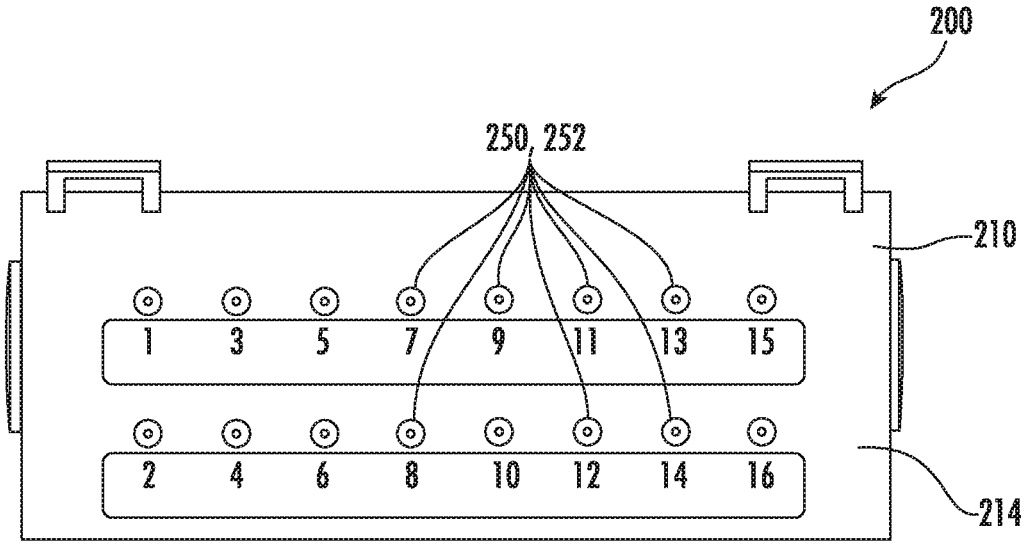
FIG. 4 is a top view of the power supply unit shown in FIG. 2.

The drawings are not necessarily to scale. The drawings are merely representations, not intended to portray specific parameters of the disclosure. The drawings are intended to depict exemplary embodiments of the disclosure, and therefore are not be considered as limiting in scope. In the drawings, like numbering represents like elements.

DETAILED DESCRIPTION

Various features, aspects, or the like of a power supply unit for use with an architectural-structure covering will now be described more fully hereinafter with reference to the accompanying drawings, in which one or more aspects of the power supply unit will be shown and described. It should be appreciated that the various features, aspects, or the like may be used independently of, or in combination, with each other. It will be appreciated that the power supply unit as disclosed herein may be embodied in many different forms and should not be construed as being limited to the embodiments set forth herein. Rather, these embodiments are provided so that this disclosure will convey certain illustrations of aspects of the power supply unit to those skilled in the art. In the drawings, like numbers refer to like elements throughout unless otherwise noted.

It should be understood that, as described herein, an "embodiment" (such as illustrated in the accompanying Figures) may refer to an illustrative representation of an environment or article or component in which a disclosed concept or feature may be provided or embodied, or to the representation of a manner in which just the concept or feature may be provided or embodied. However, such illustrated embodiments are to be understood as examples (unless otherwise stated), and other manners of embodying the described concepts or features, such as may be understood by one of ordinary skill in the art upon learning the concepts or features from the present disclosure, are within the scope of the disclosure. In addition, it will be appreciated that while the Figures may show one or more embodiments of concepts or features together in a single embodiment of an environment, article, or component incorporating such concepts or features, such concepts or features are to be understood (unless otherwise specified) as independent of and separate from one another and are shown together for the sake of convenience and without intent to limit to being present or used together. For instance, features illustrated or described as part of one embodiment can be used separately, or with another embodiment to yield a still further embodiment. Thus, it is intended that the present subject matter covers such modifications and variations as come within the scope of the appended claims and their equivalents.

As will be described in greater detail below, a power supply unit according to the present disclosure may include one or more features to simplify installation. For example, in one embodiment, the power supply unit includes a power connector accessible through an outer surface of the power supply unit for receiving line-voltage and a plurality of low-voltage connectors accessible through the outer surface for supplying low-voltage to one or more motorized architectural-structure coverings. Thus arranged, an installer does not need to access the internal circuity of the power supply unit to couple and supply power to the motorized architectural-structure coverings. In addition, and/or alternatively, in one embodiment, a cable extending between the power supply unit and the motorized architectural-structure covering includes same gender connectors for facilitating easier installation and reducing installation errors.

Referring to FIG. 1, an example of an embodiment of an architectural-structure covering 100 is illustrated. The architectural-structure covering 100 includes a covering 106 movable between a retracted position and an extended position (illustratively, the position shown in FIG. 1). For example, as illustratively shown in FIG. 1, the covering 106 can be vertically extendable or retractable (e.g., able to be lowered or raised, respectively, in a vertical direction) between the extended position and the retracted position for obscuring and exposing the underlying architectural structure.

As illustrated, the architectural-structure covering 100 may also include a headrail 108, which in the illustrated example of an embodiment is a housing having opposed end caps 110 joined by front, back, and top sides to form an open bottom enclosure. The headrail 108 may also include any suitable mounting structure for coupling the headrail 108 to a structure above, or at the top of, an architectural structure, such as a wall, via mechanical fasteners such as screws, bolts, or the like. Although a particular example of a headrail 108 is shown in FIG. 1, many different types and styles of headrails exist and could be employed in place of the example headrail of FIG. 1.

As will be readily appreciated by one of ordinary skill in the art, the architectural-structure covering 100 may include a rotatable member such as, for example, a roller tube. The covering 106 may include an upper portion or edge coupled to the rotatable member and a bottom edge or portion. The covering 106 of the architectural-structure covering 100 may be suspended from the rotatable member and may be vertically extended and retracted between the extended position (shown in FIG. 1), and the retracted position.

Although a particular example of an architectural-structure covering 100 is shown in FIG. 1, many different types and styles of architectural-structure coverings exist and can be employed in place of the example illustrated in FIG. 1. As such, it should be understood that features of the present disclosure may be used in combination with any suitable architectural-structure covering now known or hereafter developed and thus features of the present disclosure should not be limited to any particular type of architectural-structure covering. For example, it should be appreciated that the covering 106 may be a flexible material, however any suitable covering now known or hereafter developed is envisioned.

Although not shown, any appropriate now known or heretofore to be developed electric drive mechanism can be provided to move the covering 106 between the extended and retracted positions. For example, in one example of an embodiment, the architectural-structure covering 100 includes a motor such as, for example, an electric motor, for operatively moving the covering 106 between the extended and retracted positions. In one example of an embodiment where a headrail 108 is included, the motor may be positioned behind the headrail 108 (e.g., mounted to a back surface of the headrail). Alternatively, the motor may be positioned in any other suitable position, for example, within the headrail, etc. In use, the motor may receive electrical power via a wire, cord, cable, or the like. In rooms or buildings incorporating numerous motorized architectural-structure coverings 100 it is beneficial to utilize a power supply unit. In use, the power supply unit may receive mains or line-voltage power from, for example, an electrical outlet and provide low-voltage power to a plurality of motorized architectural-structure coverings 100 for supplying the required electrical power to the motors.

In accordance with one or more aspects of the present disclosure, it would be beneficial to provide a power supply unit that is installer friendly. For example, it would be beneficial to provide a power supply unit that does not require the installer to access an internal compartment of the power supply unit, thus preventing, or at least reducing the likelihood that the installer needs to manage line-voltage connections. In this manner, for example, a licensed electrician is not required to install the power supply unit. In addition, it would be beneficial to provide a power supply unit that provides increased plug and play capabilities to facilitate easier installation and thus reduces the likelihood of installation errors.

Referring to FIGS. 1-5, a power supply unit 200 in accordance with one or more principles of the present disclosure is illustrated. In use, the power supply unit 200 is arranged and configured to receive main or line-voltage power such as, for example, 110 volts, to convert the line-voltage power to low-voltage power, and to supply the low-voltage power to, for example, a motorized architectural-structure covering such as, for example, architectural-structure covering 100. In use, the low-voltage power can be provided to the motorized architectural-structure coverings to power the electrical motor used to move the covering between the extended and retracted positions. For example, the power supply unit 200 may include a transformer, an inverter, etc. to convert the line-voltage to low-voltage (e.g., to convert 110v to approximately 12 to 18v).

In accordance with one aspect of the present disclosure, the power supply unit 200 is arranged and configured such that the installer need not access the internal compartment of the power supply unit 200. That is, in one example of an embodiment, the power supply unit 200 includes an outer housing 210, a removable cover 220 (FIG. 2), and an internal compartment 230 (FIG. 3) arranged and configured to house the required circuity. In accordance with one aspect of the present disclosure, the power supply unit 200 is arranged and configured so that the installer need not access the internal compartment 230 where line-voltage power is present (e.g., installer does not need to remove the cover 220 in order to make all of the required connections to the motor and/or electrical outlet). Thus arranged, a licensed electrician is not needed to install the power supply unit 200.

Figure 5:
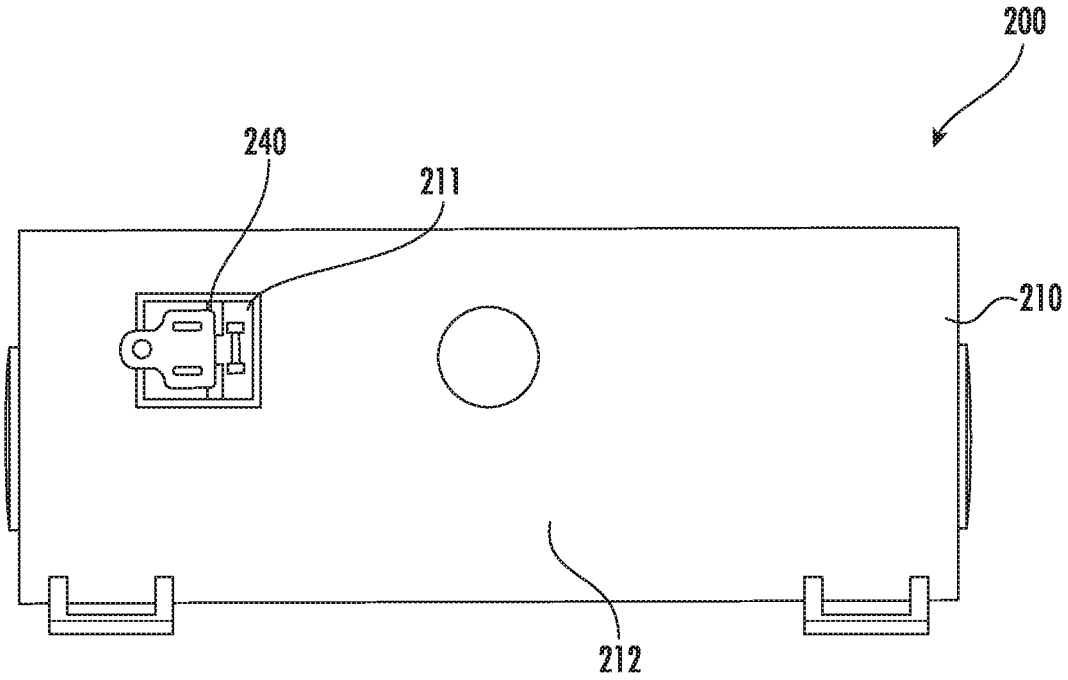
FIG. 5 is a bottom view of the power supply unit shown in FIG. 2.

In use, the power supply unit 200 may be coupled to line-voltage power by any suitable mechanism now known or hereafter developed. In accordance with one example of an embodiment, as shown, the power supply unit 200 may include a connector, a power inlet, a plug, etc. 240 (used interchangeably herein without the intent to limit) (FIG. 5). The connector 240 may be arranged and configured to receive a wire, a cord, a cable, or the like 245 (collectively referred to herein as a "power cord" without the intent to limit) (FIGS. 2 and 3), which is arranged and configured to be couple to an electrical outlet to supply power from the electrical outlet to the power supply unit 200 (e.g., to supply main or line-voltage to the power supply unit 200). For example, as shown, the power supply unit 200 may include an opening 211 (FIG. 5) formed in, for example, a bottom surface 212 of the housing 210 for providing access to the connector 240 so that the installer can connect the power supply unit 200 to an electrical outlet via a power cord 245, although the connector 240 can be positioned in other surfaces of the housing 210. It should be appreciated however that the power supply unit 200 can be coupled to line-voltage by other mechanisms.

Figure 6:
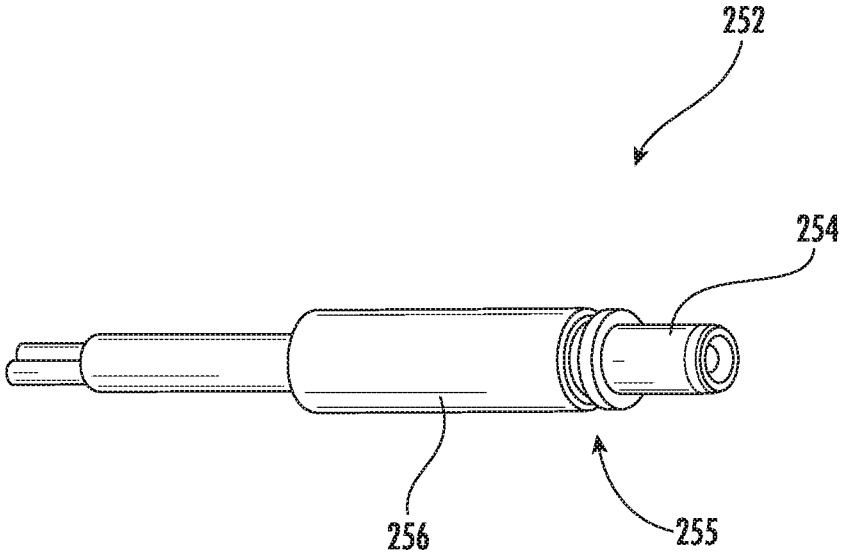
FIG. 6 is a perspective view of an example of an embodiment of a barrel or male connector that may be used in connection with the power supply unit shown in FIG. 2.
Figure 7:
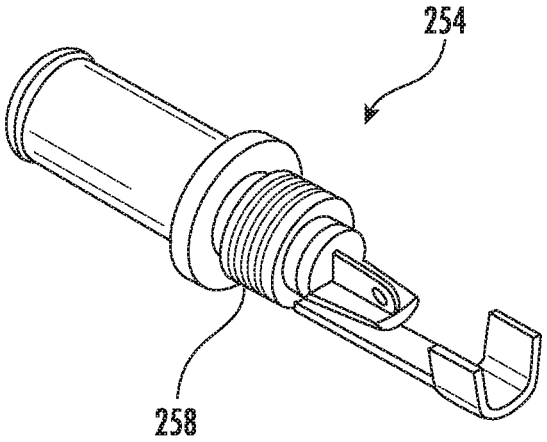
FIG. 7 is a perspective view of an example of an embodiment of a first part of the barrel or male connector shown in FIG. 6.

In addition, as shown, the power supply unit 200 may include a plurality of low-voltage connectors 250. For example, as shown, the power supply unit 200 may include a plurality of male or barrel connectors 252 (used interchangeably herein) extending through a top surface 214 of the housing 210, although the low-voltage connectors 250 can be positioned in other surfaces of the housing 210 and can be provided in any other suitable form such as, for example, as female connectors for receiving a male connector. In one example of an embodiment, the barrel connectors 252 are rigidly coupled to the housing 210 of the power supply unit 200. In one example of an embodiment, referring to FIGS. 6 and 7, the barrel connector 252 includes first and second parts 254, 256. During assembly, the first part 254 may be inserted through an opening formed in the outer surface of the housing 210. Subsequently, the second part 256 may be coupled to the first part 254. For example, as shown, the first part 254 may include external threads 258 for engaging internal threads (not shown) formed on the second part 256, or vice-versa. Thus arranged, the first and second parts 254, 256 of the barrel connector 252 may be threadably coupled to each other with a portion (e.g., wall) of the housing 210 positioned in a space 255 between the first and second parts 254, 256.

Thus arranged, referring to FIG. 1, the power supply unit 200 can be coupled to a motorized architectural-structure covering by coupling a first end 262 of a wire, cord, cable, etc. 260 (collectively referred to herein as a "cable" without the intent to limit) to one of the plurality of barrel connectors 252 and coupling the other or a second end 264 of the cable 260 to a connector 270 operatively coupled to the motor of the motorized architectural-structure covering 100.

Thus arranged, the power supply unit 200 can be assembled in the factory with all internal connections completed. That is, for example, the power supply unit 200 can be assembled so that all internal circuity within the power supply unit 200 is connected (e.g., power supply unit 200 is arranged and configured so that all internal circuity is connected to receive line-voltage power via the power connector 240 and to convert the line-voltage power to low-voltage power supplied to the barrel connectors 252 to which the motorized architectural-structure coverings 100 are coupled when installed). Thereafter, with the power supply unit 200 provided (e.g., shipped) at the installation site, the installer can couple the power supply unit 200 to a surface in a building. For example, as will be appreciated by one of ordinary skill in the art, the power supply unit 200 can be surface-mounted to a wall. Alternatively, for example, the power supply unit 200 can be flush-mounted. The power supply unit 200 can be located in the same room as the motorized architectural-structure coverings 100 or in a different room such as, for example, an electrical room, a closet, etc. As previously mentioned, the power supply unit 200 can be coupled to main or line-voltage power via coupling a power cord 245 from an electrical outlet, etc. to the power connector 240 of the power supply unit 200. Thereafter, individual cables 260 can be coupled to the barrel connectors 252 of the power supply unit 200 to each of the motors of the motorized architectural-structure covering 100. Thus arranged, power can be supplied to the motorized architectural-structure coverings 100 via the power supply unit 200 in a plug-and-play arrangement without accessing the internal circuity of the power supply unit 200. In one embodiment, all of this can be performed by a non-licensed installer including, for example, do-it-yourself ("DIY") installer.

As illustrated in FIGS. 1-5, the power supply unit 200 includes sixteen barrel connectors 252 for supplying power to sixteen motorized architectural-structure coverings 100. However, it will be understood that this is just one example and that the power supply unit 200 may be arranged and configured to supply power to more or less motorized architectural-structure coverings 100 including, for example, eight, twenty-four, thirty-two, etc.

Moreover, as shown, the power supply unit 200 may include barrel connectors 252 that are arranged and configured as male connectors. It should be appreciated that the barrel connectors 252 may have any suitable shape and/or configuration for transferring low-voltage power. Alternatively, the connectors 250 may be arranged and configured as female connectors. Moreover, the connectors 250 may be in the form coaxial connectors, plug connectors, etc.

Referring to FIG. 1, in accordance with another aspect of the present disclosure, which can be used in connection with or independently from, the aspects previously disclosed, the cable 260 extending between the power supply unit 200 and the motorized architectural-structure covering 100 may be arranged and configured to utilize the same type or style connector 265 on both the first and second ends 262, 264 of the cable 260 (e.g., the power supply unit 200 includes the same gender connector 250 as the connector 270 coupled to the motor so that the cable 260 extending between the power supply unit 200 and the motorized architectural-structure covering 100 includes the same gender connector 265 on both ends 262, 264 thereof so that the cable 260 is not specific as to which end is coupled to the motorized architectural-structure covering 100 and which end is coupled to the power supply unit 200).

That is, for example, as previously described, the barrel connectors 252 may be arranged and configured as male connectors for receiving corresponding female connectors. In one example of an embodiment, the motor of the motorized architectural-structure covering is also arranged and configured with a male connector 270 for receiving a corresponding female connector. Thus arranged, the cable 260 extending between the power supply unit 200 and the motor of the motorized architectural-structure covering 100 may include female connectors 265 at both ends 262, 264 (e.g., cable 260 includes a female connector 265 at the first end 262 for coupling to the barrel connector 252 and a female connector 265 at the second end 264 for coupling to a male connector 270 coupled to the motor). Alternatively, as will be appreciated, the cable may be arranged and configured to include dual male connectors (e.g., a male connector at the first end for coupling to a female connector of the power supply unit and a male connector at the second end for coupling to a female connector extending from the motor).

Thus arranged, coupling the power supply unit 200 to the motorized architectural-structure covering 100 can be achieved in a simplified, installer friendly manner. For example, by providing the same gender connectors 265 on both ends 262, 264 of the cable 260 extending between the power supply unit 200 and the motorized architectural-structure covering 100, the cable 260 can be run without concern for which end of the cable 260 is positioned adjacent to the power supply unit 200 and which end is positioned adjacent to the architectural-structure covering 100. Moreover, the power supply unit 200 can be provided with a plurality of cables 260 including a plurality of corresponding connectors 265 that are separated from the cable 260 such as, for example, provided in a bag. Thereafter, the installer, after having run the cable 260 between the power supply unit 200 and the architectural-structure covering 100 can cut the cable 260 to the appropriate length, as required, can simply couple one of the corresponding connectors 265 to the end of the cable 260, and couple the connector 265 to the connector 270 extending from the motor or the barrel connector 252 of the power supply unit 200. As will be appreciated, pre-planning the connection is eliminated, or at least greatly minimized, thereby facilitating easy installation.

For the sake of convenience and clarity, referring to FIG. 1, all directional references or terms used herein such as, for example, "face," "front," "back," "rear," "top," "bottom," "up," "down," "vertical," "horizontal", "inner," "outer", "proximal," "distal," "upper," "lower," "upward," "downward," "left", "right," "lateral," "longitudinal," "above," "below," "vertical," "horizontal," "radial," "axial," "clockwise," and "counterclockwise" are only used for identification purposes to aid the reader's understanding of the present disclosure, and do not create limitations, particularly as to the position, orientation, or use of this disclosure. These references are used herein to describe the relative placement and orientation of various components and portions of the architectural-structure covering 100, each with respect to the geometry and orientation of the architectural-structure covering 100 as they appear in FIG. 1. Said reference is intended to be non-limiting and is used herein merely to describe relationship between various components as illustrated in FIG. 1.

Although a particular example of an architectural-structure covering 100 is shown in FIG. 1, many different types and styles of architectural-structure coverings exist and can be employed in place of the example illustrated in FIG. 1. As such, it should be understood that features of the present disclosure may be used in combination with any suitable architectural-structure covering now known or hereafter developed and thus features of the present disclosure should not be limited to any particular type of architectural-structure covering. For example, it should be appreciated that the covering may be any suitable coverings now known or hereafter developed. In addition, the various features described herein may be used separately or jointly in any combination. As such, the present disclosure should not be limited to the specific illustrations and details described herein unless specifically claimed.

While the present disclosure refers to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The foregoing description has broad application. It should be appreciated that the concepts disclosed herein may apply to many types of coverings, in addition to the coverings described and depicted herein. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

It should be understood that, as described herein, an "embodiment" (such as illustrated in the accompanying Figures) may refer to an illustrative representation of an environment or article or component in which a disclosed concept or feature may be provided or embodied, or to the representation of a manner in which just the concept or feature may be provided or embodied. However, such illustrated embodiments are to be understood as examples (unless otherwise stated), and other manners of embodying the described concepts or features, such as may be understood by one of ordinary skill in the art upon learning the concepts or features from the present disclosure, are within the scope of the disclosure. In addition, it will be appreciated that while the Figures may show one or more embodiments of concepts or features together in a single embodiment of an environment, article, or component incorporating such concepts or features, such concepts or features are to be understood (unless otherwise specified) as independent of and separate from one another and are shown together for the sake of convenience and without intent to limit to being present or used together. For instance, features illustrated or described as part of one embodiment can be used separately, or with another embodiment to yield a still further embodiment. Thus, it is intended that the present subject matter covers such modifications and variations as come within the scope of the appended claims and their equivalents.

As used herein, an element or step recited in the singular and proceeded with the word "a" or "an" should be understood as not excluding plural elements or steps, unless such exclusion is explicitly recited.

The phrases "at least one", "one or more", and "and/or", as used herein, are open-ended expressions that are both conjunctive and disjunctive in operation. The terms "a" (or "an"), "one or more" and "at least one" can be used interchangeably herein. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative to sizes reflected in the drawings attached hereto may vary.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

What is claimed:

1. A power supply unit arranged and configured to supply low-voltage power to a plurality of motorized architectural-structure coverings, each of the plurality of motorized architectural structure coverings including a motor for moving a covering between an extended position and a retracted position, the power supply unit comprising:

a housing including an outer surface, a removable cover, and an internal compartment including electronic circuitry for converting line-voltage power to low-voltage power;

a power connector accessible through said outer surface of said housing for receiving the line-voltage power; and a plurality of low-voltage connectors, said plurality of low-voltage connectors being configured as male connectors so that said male connectors extend outside of said outer surface of said housing for supplying the low-voltage power to the plurality of motorized architectural-structure coverings.

2. The power supply unit of claim 1, wherein said plurality of male connectors extend through a top surface of said housing.

3. The power supply unit of claim 1, wherein said plurality of male connectors are rigidly coupled to said housing.

4. The power supply unit of claim 1, wherein said power supply unit is arranged and configured so that all internal connections between said power connector and said plurality of low-voltage connectors is performed in a factory so that an installer does not need to access said internal components.

5. The power supply unit of claim 1, wherein said power connector is a plug arranged and configured to receive a power cord, said power cord being arranged and configured to connect to an electrical outlet for supplying the line-voltage power to said power supply unit.

6. The power supply unit of claim 5, wherein said housing includes an opening formed in a bottom surface thereof, said plug being accessible through said opening formed in said bottom surface.

7. The power supply unit of claim 1, further comprising a plurality of cables, each cable including:

a first end having a first connector for coupling to one of said plurality of low-voltage connectors of said power supply unit; and a second end having a second connector arranged and configured to couple to a connector associated with one of the motorized architectural-structure coverings.

8. The power supply unit of claim 7, wherein:

said first connector of said first end of said cables is a female connector for coupling to one of said plurality of low-voltage connectors of said power supply unit; and said second connector of said second end of said cables is a female connector for coupling to said connector associated with one of the plurality of motorized architectural-structure coverings.

9. The power supply unit of claim 7, wherein:

said first connector of said first end of said cables is a male connector for coupling to one of said plurality of low-voltage connectors of said power supply unit; and said second connector of said second end of said cables is a male connector for coupling to said connector associated with one of the plurality of motorized architectural-structure coverings.

10. A method of supplying power to one or more motorized architectural-structure coverings, the method comprising:

coupling a power supply unit to a wall, the power supply unit including electronic circuitry for converting line-voltage power to low-voltage power;

coupling a power cord to an electrical outlet positioned in said wall and to a power connector accessible through an outer surface of said power supply unit for supplying the line-voltage power to said power supply unit; and coupling one or more motorized architectural-structure coverings to said power supply unit via a plurality of low-voltage male connectors accessible outside of said power supply unit for supplying the low-voltage power to said one or more motorized architectural-structure coverings.

11. The method of claim 10, wherein said power supply unit includes an opening formed in a bottom surface thereof, said power connector being accessible through said opening formed in said bottom surface.

12. The method of claim 10, wherein coupling the one or more motorized architectural-structure coverings to said power supply unit comprises running a cable between said power supply unit and each of said one or more motorized architectural-structure coverings, respectively, wherein each cable includes:

a first end having a first connector for coupling to one of said plurality of low-voltage male connectors of said power supply unit; and a second end having a second connector arranged and configured to couple to a connector associated with one of said motorized architectural-structure coverings;

wherein said first connector and said second connector include same gender connectors.

13. The method of claim 10, wherein coupling one or more motorized architectural-structure coverings to said power supply unit comprises:

running a cable between said power supply unit and each of said one or more motorized architectural-structure coverings, respectively;

coupling a first connector to a first end of said cable for coupling said cable to one of said plurality of low-voltage male connectors of said power supply unit; and coupling a second connector to a second end of said cable for coupling said cable to one of said motorized architectural-structure coverings;

wherein said first connector is the same as said second connector.

14. The method of claim 10, wherein coupling a power cord to an electrical outlet and coupling one or more motorized architectural-structure coverings to said power supply unit are performed by an installer without accessing internal components of said power supply unit.

* * * * *